United States Patent [19]

Riegelman et al.

[11] 4,245,436

[45] Jan. 20, 1981

[54] METAL WINDOW WITH OFFSET SASH AND BALANCE MECHANISMS

[75] Inventors: Harry M. Riegelman, Diamond Bar; Vernon E. Madison, Orange, both of Calif.

[73] Assignee: Rusco Industries, Inc., Fullerton, Calif.

[21] Appl. No.: 75,793

[22] Filed: Sep. 14, 1979

[51] Int. Cl.[3] ..... E05D 13/10

[52] U.S. Cl. ..... 49/446; 49/150

[58] Field of Search ..... 49/446, 445, 150, 181

[56] References Cited

U.S. PATENT DOCUMENTS

| | | | |
|---|---|---|---|
| 2,791,795 | 5/1957 | Haas | 49/446 X |
| 3,449,862 | 6/1969 | Biro | 49/446 X |
| 3,499,248 | 3/1970 | Baer | 49/446 X |

FOREIGN PATENT DOCUMENTS

| | | | |
|---|---|---|---|
| 1002338 | 8/1965 | United Kingdom | 49/445 |

*Primary Examiner*—Kenneth Downey
*Attorney, Agent, or Firm*—Perry E. Turner

[57] ABSTRACT

There is disclosed a metal window frame in which balance mechanisms are positioned in the upper portions of the jambs adjacent the sides of a fixed pane or panes, the front faces of the housings for such mechanisms being in a plane parallel to the outer face of a sash that is slidable from a closed position in the lower portion of the frame to a fully open position in the upper portion thereof. The mechanisms and sash are coupled via identical foot structures which are attached to the lower ends of the balances, and which have hook portions extending through the plane of the outer face portion of the sash so as to maintain engagement with the lower end of the sash throughout its normal movement. Catches in the jambs limit the upper position of the foot structures when the sash is raised to an uppermost position for removal from the frame. In takeout position, the sash is movable laterally so that one side passes into the adjacent jamb without contacting the balance, the other side of the sash clearing its jamb so it can be swung clear and permit the sash to be lifted out of the frame. Upon reinsertion of the sash and lowering it, respective hook portions of the foot structures are automatically engaged by the sash for normal operation.

6 Claims, 14 Drawing Figures

METAL WINDOW WITH OFFSET SASH AND BALANCE MECHANISMS

CROSS-REFERENCE TO RELATED APPLICATION

This application is related to our copending application, "Aluminum Hung Window and Takeout Mechanism Therefor," filed concurrently herewith.

BACKGROUND OF THE INVENTION

1. Field of the Invention

This invention relates to metal window structures with takeout sashes and associated balance mechanisms.

2. Description of the Prior Art

In a typical window heretofore known with a takeout sash, the sash in the takeout position has its end faces confronting respective balance mechanism. Each balance at its lower end has a foot member connected thereto which confronts the adjacent sash end face, and which has a lip engaging the sash in normal sliding movement and from which the sash disengages when it is moved to the takeout position. When the sash is to be removed at takeout position, it is moved laterally so one side abuts the adjacent balance and the other side clears its jamb and is swung clear to permit the sash to be lifted free of the frame. The normal space between the confronting faces of the sash and balance mechanisms is quite narrow, and considerable jiggling of the sash is undertaken to maneuver it to the position where there is the needed clearance to permit one side to be swung free on takeout, or swung in on reinsertion of the sash. In both operations, there is accompanying undesirable striking contact between the confronting faces of the sash and balance housings, and resulting damage to the parts.

SUMMARY OF THE INVENTION

This invention embraces a window structure in which balance mechanisms are not in the path of movement of a sash, but are positioned so the faces of their housings are in a plane parallel to the sash, whereby the sash is easily movable laterally a sufficient distance on takeout or reinsertion to avoid the above described problems of the prior art. Also embraced is such window structure employing foot structures with hook portions which extend through the sash plane to releasably engage the bottom of the sash, and which accommodate sliding movement and quick takeout and reinsertion of the sash. Further embraced by this invention is such a foot structure in which sash engaging portions at both ends of the sash accommodate lateral play of the sash during movement without binding.

DESCRIPTION OF ILLUSTRATIVE EMBODIMENTS

Figure 1:
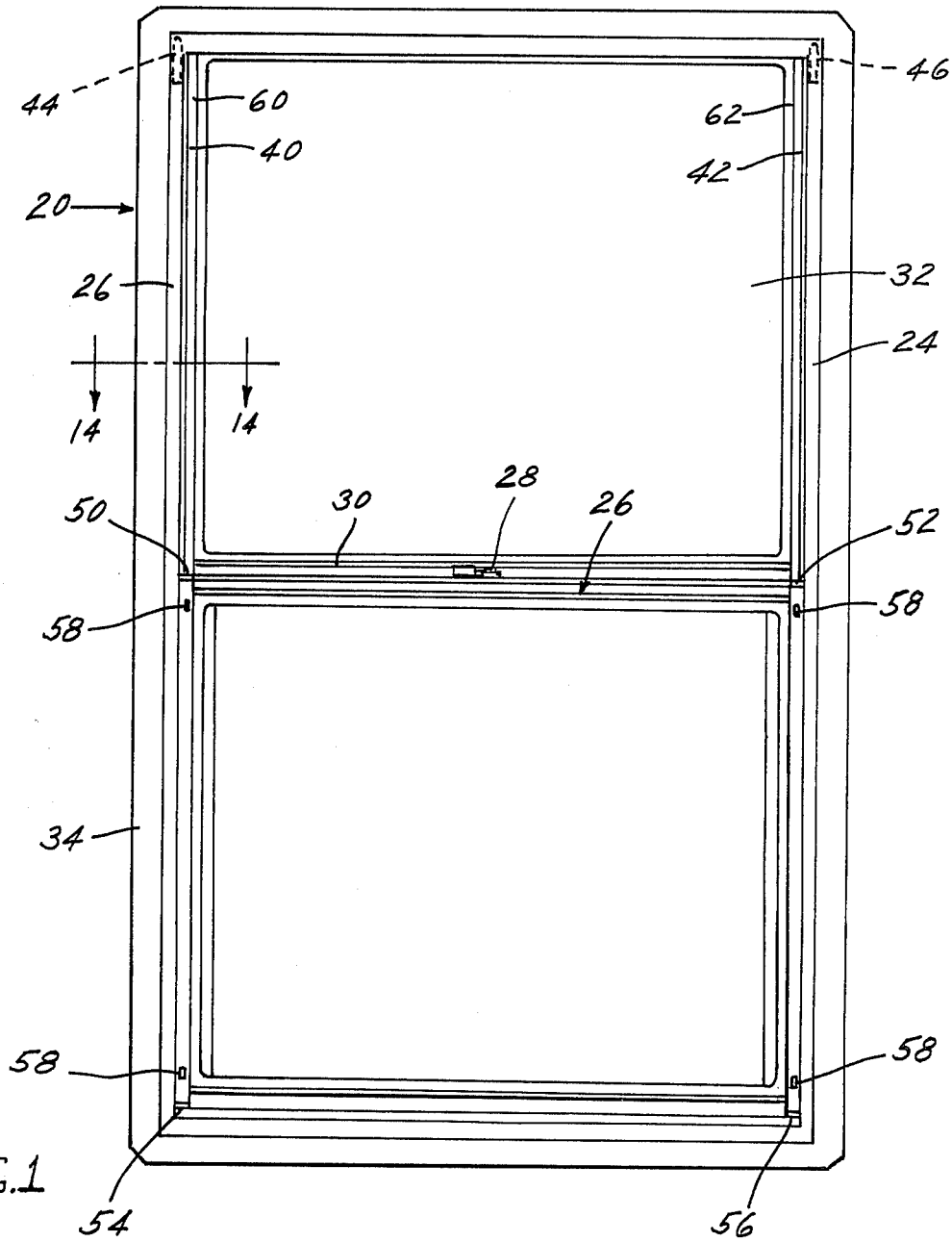
FIG. 1 is a front elevation view of the interior of a single hung window of the invention.
Figure 2:
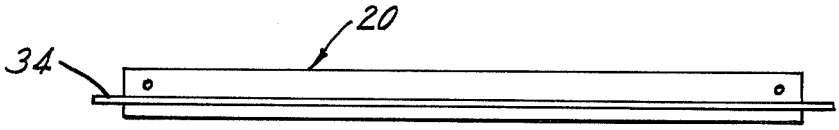
FIG. 2 is a top end view of the window of FIG. 1.

Referring to FIGS. 1 and 2, a window structure is shown with a frame 20 having jambs 22, 24 in which the sides of a sash 26 are located. The sash is adapted to be locked in its lower position, shown in FIG. 1, as via a cam lock 28 mounted on the top of the sash and adapted to releasably lockingly engage a rail 30 located adjacent the bottom of a fixed panel 32, which panel may include a single pane of glass or spaced panes in a desired thermal frame glazed with insulating glass. If desired, the frame 20 may be provided with an encircling fin 34 to simplify flashing application and provide a desired weather-resistant installation.

Mounted within the jambs in the upper portion of the frame are balance mechanisms 40, 42, the front faces of the housings of which are substantially coplanar with the portions of the frame forming the inner walls of the jambs. Also mounted within the jambs are limit stop members 44, 46 which are normally vertically oriented with their lower ends in interference relation with the top of the sash when it is raised to its normal uppermost position. In such position, the stop members 44, 46 prevent the sash being moved to its takeout position. When it is desired to move the sash to takeout position, the stop members are swiveled on their upper ends and inwardly to horizontal positions, thus providing clearance for sufficient further upper movement of the sash to takeout position. When the stop members are moved between their vertical and horizontal positions, their free ends ride on the inner faces of the housings of the balances 40, 42 and over the adjacent jamb wall faces.

Preferably, the sash 26 is provided with corner inserts 50, 52, 54, 56 with respective spring biased buttons 58 extending through the inner stile faces of the sash 26. When the sash is in its takeout position, the two buttons 58 on one side of the sash are depressed to facilitate movement of the sash laterally so that such one side enters its jamb so the other side clears its jamb and can be swung out for removing the sash from the frame. Our above-mentioned copending application can be referred to for a detailed description of the constructions of the stop members 44, 46 and the inserts 50, 52, 54, 56 with their associated spring biased buttons 58.

Figure 14:
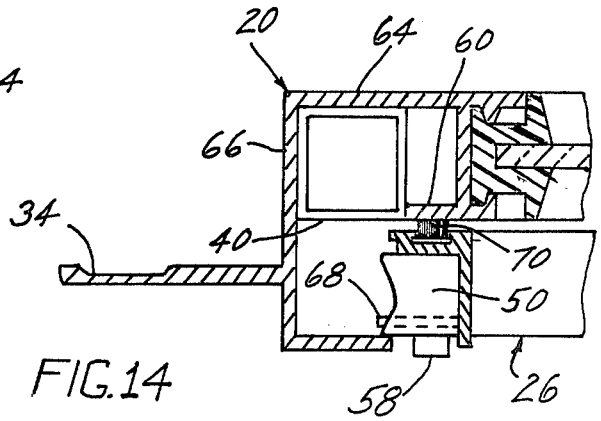
FIG. 14 is a fragmentary sectional view taken along the line 14—14 of FIG. 1, showing the offset relation of the balance mechanism and the sash, and revealing the ample space accorded lateral movement of the sash into the jamb for takeout or reinsertion purposes.

Referring to FIG. 14 along with FIGS. 1 and 2, the previously mentioned interior jamb walls are shown as ribs 60, 62 which extend from the outer wall 64 of the frame 20, and which are shaped to present flat wall surfaces parallel to the inner walls of the jambs 22, 24. The end wall 66 of the frame together with the wall 64 and rib 60 define the space to receive the housing of the balance 40.

Also as best seen in FIG. 14, the sash 26 is shown with a channel shaped stile 68 in which the insert 50 is positioned, the inner wall of the stile having an opening at each location through which a respective button 58 projects. The inner wall of the stile carries a length of weatherstripping 70 which engages the inner face of the rib 60. In addition to providing protection against entry of dirt and moisture when the sash is closed, the weatherstrip aids in effecting smooth gliding movement of the sash.

In this latter regard, each insert, as shown for the insert 50 in FIG. 14, keeps the inner wall of the stile spaced from the jamb. Such spacing is effected by the lip portion of each insert that is effectively hooked over the end of the stile. As described in our aforementioned copending application, the inserts preferably are of molded plastic material to insure relatively frictionless engagement thereof with the confronting metal walls of the jambs. Thus, the sash rides smoothly due to the plastic-to-metal contact between the inserts and the jambs, and to the engagement of the weatherstrips 70 with the metal facing of the ribs 60, 62.

FIG. 14 also illustrates the advantage of the window structure of this invention to facilitate quick and easy takeout and reinsertion of the sash. Assuming in FIG. 14 that the sash is in takeout position, it will be noted that movement of the sash to the left, following depression of the buttons 58 to permit such movement, finds ample space through which the sash can be moved in that direction. This permits the opposite stile to easily clear its jamb, and thus swung out so the sash can be lifted out of the frame. Similarly, reinsertion of the sash is easily and quickly effected. In both takeout and reinsertion maneuvering thereof, the sash does not move against or strike a balance, and the invention thus eliminates the striking and damage to such parts as is permitted by prior art window structures wherein the balances are in the paths of the sash when it is moved laterally.

Figure 3:
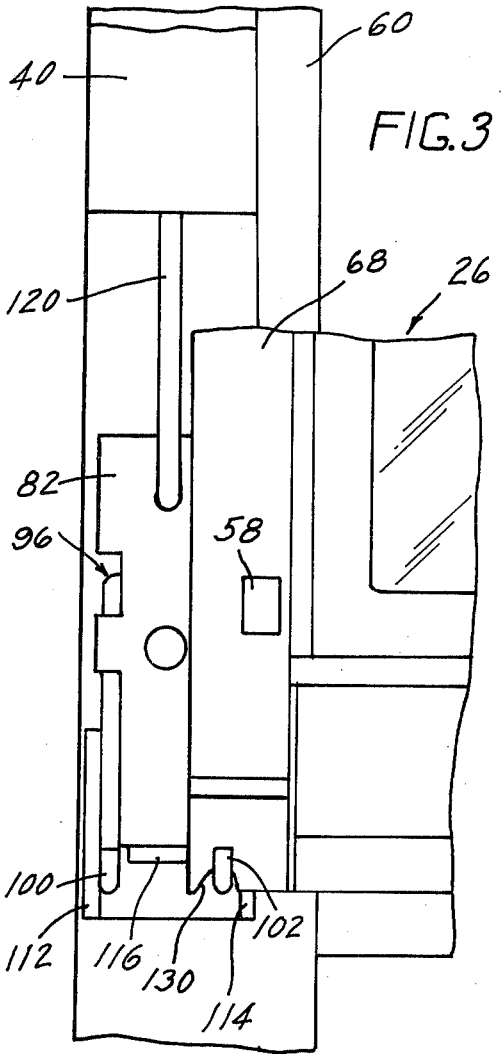
FIG. 3 is a fragmentary view, partly broken away, of the left lower corner portion of the sash, showing the engagement therewith of the hook of a foot structure of the invention coupling the sash to a block and tackle balance.
Figure 4:
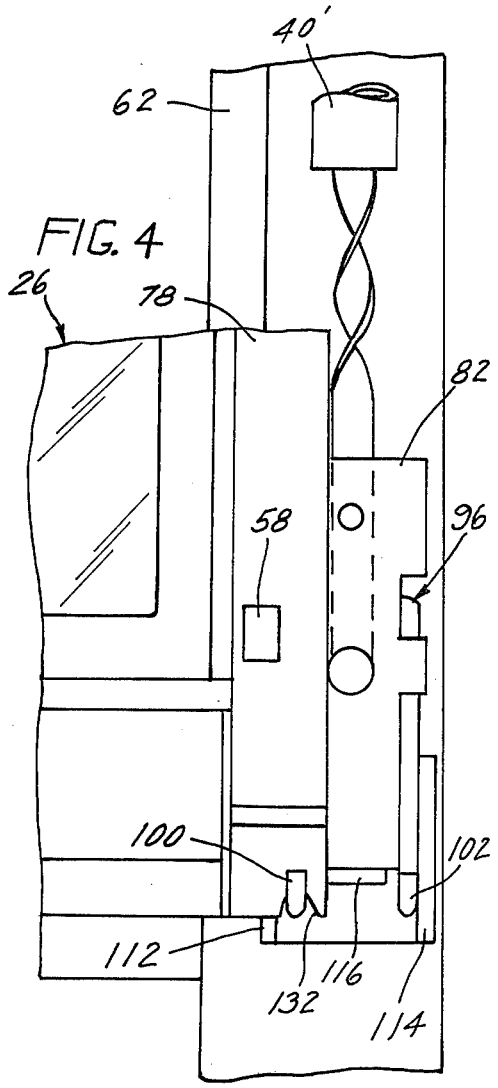
FIG. 4 is a fragmentary view, partly broken away, of the right lower corner portion of sash, showing the engagement therewith of another hook portion of the foot structure coupling the sash to a spiral balance.
Figure 5:
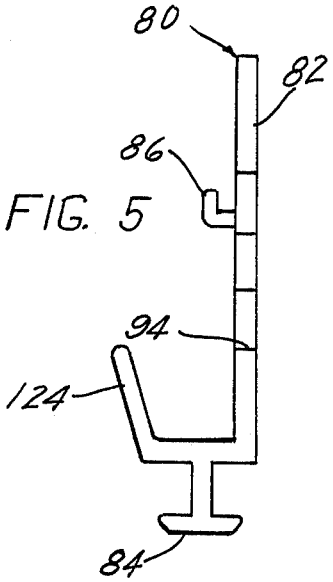
FIG. 5 is a side elevation view of the frame of the foot structure of FIGS. 3 and 4.
Figure 6:
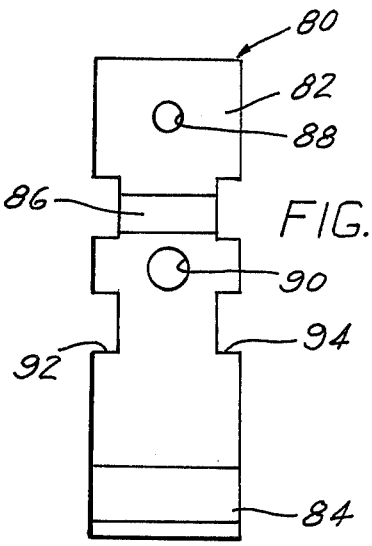
FIG. 6 is a view in elevation of the frame as seen from the left in FIG. 5.

FIGS. 3 and 4 illustrate engagement of the ends of the sash by a balance foot structure in accordance with this invention. FIG. 3 shows the window structue with a balance 40 of the block and tackle type, and FIG. 4 shows the window structure with a spiral balance 40'. In either case, the same foot structure is used to engage the lower ends of the inner walls of the stiles 68, 78. In this regard, and referring to FIGS. 5–12 for the form of foot structure used in FIGS. 3 and 4, a three-piece device is unified from plastic and metal elements. FIGS. 5 and 6 show the carrier or base support element 80, which is a substantially J-shaped plate 82 from the bottom of which depends a flange or foot bar 84. The plate 82 has an integral hook bar 86 extending from its rear face located a short distance below its upper end. The plate 82 also has an upper opening 88 to receive the cord of a block and tackle balance mechanism, and a lower opening 90 via which to rivet the lower straight end portion of the spiral blade of a spiral balance.

Figure 10:
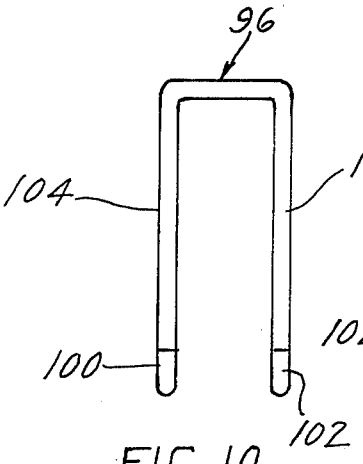
FIG. 10 is a view in elevation of the U-shaped hook element as seen from the position showing both hook ends.
Figure 11:
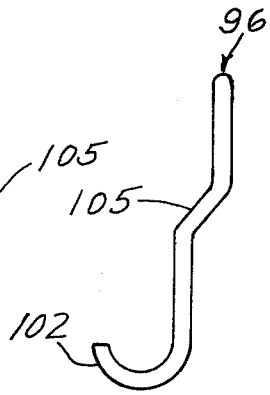
FIG. 11 is a side elevation view of the hook element as seen from the right of FIG. 10.

The plate 82 also has edge notches 92, 94 through which to pass the arms of a spring hook element 96, shown in FIGS. 10 and 11. As seen in FIG. 10, the hook element 96 is a substantially U-shaped element in front elevation, with legs bent at their lower ends to form hooks 100, 102. As seen in FIG. 11, each leg in profile is J-shaped with a double bend portion effecting offset relation between its upper and lower portions. This configuration permits the upper portion of the hook element 96 to be placed over the hook bar 86 of the plate 82, with the double bent portions 104, 105 of the legs extending through the notches 92, 94 of the plate, and with the lower straight portions of the legs extending along the front face of the plate 82. The hook ends 100, 102 of the hook element extend below the plate 82 as can best be seen with reference to FIG. 12.

Figure 7:
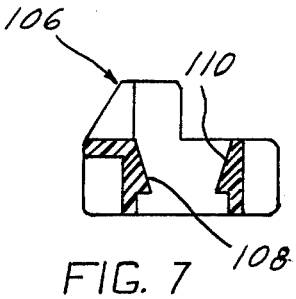
FIG. 7 is a longitudinal sectional view of the molded plastic foot guide which interlocks with the frame of the foot structure after the hook element is positioned thereon.
Figure 8:
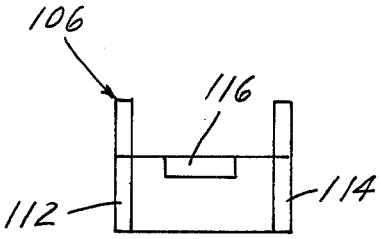
FIG. 8 is a view in elevation of the foot guide as seen from the left of FIG. 7.
Figure 9:
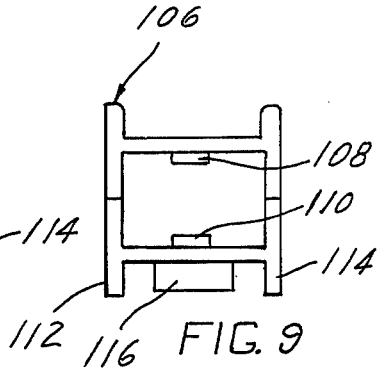
FIG. 9 is a view in elevation of the foot guide as seen from the right of FIG. 7.

In assembly, the hook element 96 is the first element positioned on the plate 82. The third element of the foot balance is a plastic shoe member 106, which is shown in FIGS. 7–9. FIG. 7 shows the cross-section of the shoe member 106 to provide downwardly converging surfaces which terminate in horizontal shoulder transitions to the vertical. The lower ends of the converging surfaces 108, 110 are spaced apart slightly less than the width of the bar 84 depending from the plate 82. After the hook element 96 is positioned on the plate 82 as above described, the bar is thrust through the shoe member 106 and past the lower ends of the tapered surfaces 108, 110, thereupon locking the plate and shoe member together, and trapping the hook element in the assembly.

As best seen with reference to FIGS. 8 and 9, the shoe member 106 has wall extensions 112, 114 between which is a projection 116. The spaces between the edges of the projection 116 and the adjacent walls 112, 114 are substantially wider than the diameter of the lower portions of the legs of the hook element which extend through such spaces, as will be observed in FIGS. 3 and 4. The legs of the hook element can thus undergo limited lateral movements. As will be seen, this provision permits the foot balance to adjust to and accommodate slight lateral movements of the sash as the sash is moving vertically.

Figure 12:
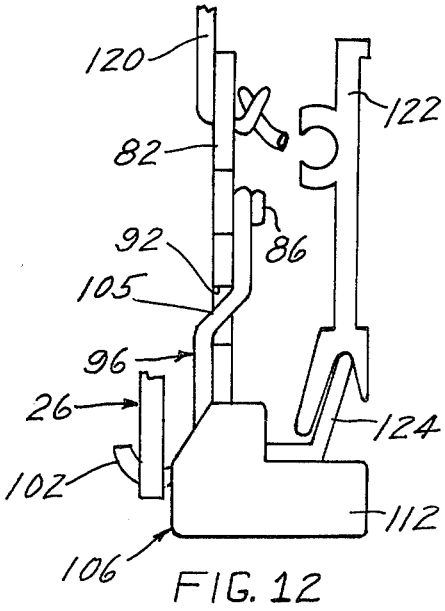
FIG. 12 is a side elevation view of the assembled foot structure in sash-engaging position, and showing a clip engaged by the foot structure to limit further upper movement of the foot structure with the sash, such further movement of the sash clearing the hook and permitting removal of the sash.

FIG. 12 shows the cord 120 of a block and tackle balance knotted to the plate 82. FIG. 12 also shows a stop member 122 disposed in the path of the foot balance, and which is engaged by the short back leg 124 of the plate 82 when the sash, indicated at 26, is raised to the position from which additional elevation is to place the sash in takeout position, lifting the sash off the balance foot and freeing it from removal from the window frame. Such a stop member 122 is secured to the outer wall of each jamb in any suitable manner.

Again referring to FIGS. 3 and 4, it will be noted that the sash stiles 68 and 78 in this embodiment are formed with notches 130, 132 in the lower ends of the inner walls of the stiles. For the balance foot in FIG. 3, the stile 68 is in engagement with the hook end 102, which is the leg of the hook element nearest the sash. In FIG. 4, the stile 78 is engaged with the hook end 100 of the leg nearest the sash. Thus, it will be seen that the balance foot structure readily adapts to either side of the sash.

Figure 13:
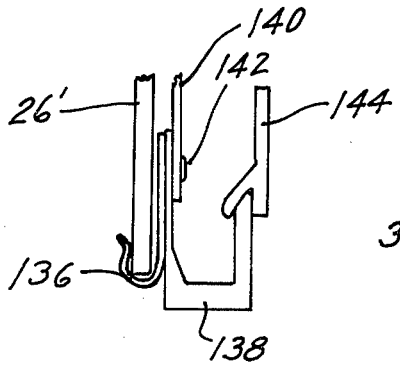
FIG. 13 is a side elevation view of another form of assembled foot structure embraced by this invention, shown in sash-engaging position with the hook portion in releasable engagement with the bottom of the sash.

FIG. 13 illustrates a balance foot structure embraced by this invention, wherein the sash 26' is not notched as for the stiles in FIGS. 3 and 4, and instead is engaged with the hook end of a flat spring type hook element 136. The hook element 136 in this embodiment is secured to the longer leg of a J-shaped base plate 138, and to which the lower end of the spiral element of a spiral balance is riveted, as the element 140 indicated to be riveted at 142. The shorter leg of the base plate 138 is engageable with a stop member 144 disposed in its path at a predetermined sash position, so that further upward movement of the sash clears it from the hook element 136 and permits takeout.

It will be appreciated that the hook element 136 may also be the type having two hook ends, and operable as with the embodiment previously described to have a respective hook end engage the sash in a notch as in such embodiment. Also, the embodiment of foot structure shown in FIGS. 5–12 may be employed with a sash for which the stiles are not notched.

Thus, it will be appreciated that either balance foot structure heretofore described can be used with the sashes described with reference to FIGS. 3, 4 and 13. Also, the various parts may be made of any suitable materials which will serve to support a sash and function for the above described purposes. In one form for the foot balance of FIGS. 5–12, the base plate 82 is metal, the hook element 96 is metal, and the shoe member is the aforementioned plastic, e.g., Delrin, to provide desired frictionless contact with metal walls of the jamb. In the preferred form of the balance foot structure of FIG. 13, the base plate 138 is of such plastic material and for the same purpose.

We claim:

1. A metal window structure comprising:

a vertical frame having jambs for a sash said frame being channel shaped with a rib extending from one wall and terminating in a flat surface parallel to said one wall and to the opposite wall of said frame;

a sash having stiles extending into said jambs and slidable therein, the stile in each jamb being disposed between the flat surface of said rib and the opposite wall of said frame;

a pair of balance mechanisms in said frame, each balance mechanism being located between the plane of said flat surface and said one wall of said frame, whereby lateral movement of said sash for takeout or reinsertion is effected parallel to and without interference relation with said balance mechanisms;

a respective balance foot structure coupling each balance mechanism to the sash, said balance foot structures including respective clip elements extending past said plane and in the paths of said stiles of said sash;

and stop means in said frame engageable by said balance foot structures at a predetermined elevated position of said sash, such that said sash disengages from said balance foot structures upon vertical movement of said sash above said predetermined position and is thereby free for takeout.

2. The combination of claim 1, where each stile includes a wall confronting said flat surface and having a portion thereof confronting a respective balance mechanism, the lower end of each said stile wall engaging a respective clip element at and below said predetermined elevated position of said sash.

3. The combination of claim 2, wherein each balance foot structure is composed of a base plate, metal spring clip and plastic shoe member, said spring clip being a U-shaped member having its mid-portion hooked to said base plate on one side thereof, the legs of said spring clip extending past the edges of said base plate to the opposite side thereof, the lower end of said base plate and said shoe member being interlocked, the hook end of each leg of said spring clip extending beyond said shoe member, the hook end of one leg of each spring clip being engaged with the associated sash stile.

4. The combination of claim 3, wherein each stile wall has a notch in its lower end, the hook end of the nearest spring clip leg engaging with each said stile wall in the notch thereof, said shoe member being configured to confine each associated spring clip leg but permitting limited lateral leg movement for accommodating lateral sash movement during vertical sash travel.

5. The combination of claim 3, wherein said base plate is a metal element, said base plate having notches in its edges and a bar on one surface above said notches, said bar providing a groove to receive the mid-portion of said spring clip, the legs of said spring clip having double bend portions extending through said notches to the opposite surface of said base plate, the portions of said legs below said notches extending along said opposite surface.

6. A foot structure for coupling a balance mechanism and window sash comprising:

a base plate having a lateral hook bar on one surface and a flanged foot depending from its lower end, said plate also having a leg extending from its lower end on the same side as said bar;

said plate having notches in its edges;

a spring clip having its mid-portion captured by said bar, said clip having legs extending from said bar and through said notches and along the opposite surface of said base plate, and having hook ends extending below the lower end of said base plate;

and a shoe member of plastic material interlocked with said flanged foot, and having walls between which said clip legs are confined, said shoe member including stop means between said clip legs to restrict lateral movements thereof between said walls and said stop means.

* * * * *